US010665929B2

(12) United States Patent
Gaudette et al.

(10) Patent No.: US 10,665,929 B2
(45) Date of Patent: May 26, 2020

(54) THREE AXIS REFLECTOR DEPLOYMENT AND POINTING MECHANISM

(71) Applicant: MacDonald, Dettwiler and Associates Corporation, Ste-Anne-de-Bellevue (CA)

(72) Inventors: Yves Gaudette, St-Lazare (CA); Serge Samson, St-Joseph-de-Lac (CA); Luis Martins-Camelo, Pointe-Claire (CA); Jasmin McFadden, Laval (CA)

(73) Assignee: MACDONALD, DETTWILER AND ASSOCIATES CORPORATION, Ste-Anne-de-Bellevue, Québec (CA)

( * ) Notice: Subject to any disclaimer, the term of this patent is extended or adjusted under 35 U.S.C. 154(b) by 161 days.

(21) Appl. No.: 15/480,941

(22) Filed: Apr. 6, 2017

(65) Prior Publication Data

US 2017/0294707 A1 Oct. 12, 2017

Related U.S. Application Data

(60) Provisional application No. 62/319,126, filed on Apr. 6, 2016.

(51) Int. Cl.

| | |
|---|---|
| ***H01Q 1/28*** | (2006.01) |
| ***H01Q 19/10*** | (2006.01) |
| ***H01Q 1/12*** | (2006.01) |
| ***H01Q 15/18*** | (2006.01) |

(52) U.S. Cl.
CPC ..... *H01Q 1/28* (2013.01); *H01Q 1/125* (2013.01); *H01Q 1/1235* (2013.01); *H01Q 1/288* (2013.01); *H01Q 15/18* (2013.01); *H01Q 19/10* (2013.01)

(58) Field of Classification Search
CPC .. H01Q 1/28; H01Q 3/08; H01Q 1/08; H01Q 1/1235; H01Q 3/04; H01Q 15/18; H01Q 1/288; H01Q 19/10; H01Q 1/125
USPC ..... 343/705, 881, 757, 878
See application file for complete search history.

(56) References Cited

U.S. PATENT DOCUMENTS

| | | | | |
|---|---|---|---|---|
| 5,929,817 A * | 7/1999 | Clark | H01Q 1/1235 | 343/711 |
| 2007/0146227 A1* | 6/2007 | Brooks | B64G 1/222 | 343/881 |
| 2009/0040130 A1* | 2/2009 | Conrad | H01Q 1/1214 | 343/882 |

* cited by examiner

*Primary Examiner* — Dameon E Levi
*Assistant Examiner* — Jennifer F Hu
(74) *Attorney, Agent, or Firm* — Praxis

(57) ABSTRACT

A reflector deployment and pointing mechanism, for deploying and pointing a reflector of an antenna movably mounted on a structure, has a first actuator mounted on the structure, a second actuator mounted on the first actuator, and a third actuator mounted on the second actuator and connected to the reflector. The first or second actuator is the deployment actuator, and, respectively, the second or first, and the third actuators are the pointing actuators and have their axis of rotation generally intersecting a feed oriented point of a signal reflecting surface of the reflector.

10 Claims, 3 Drawing Sheets

THREE AXIS REFLECTOR DEPLOYMENT AND POINTING MECHANISM

CROSS REFERENCE TO RELATED APPLICATION

This application claims priority of U.S. Provisional Application for Patent No. 62/319,126 filed Apr. 6, 2016, the content of which is incorporated herein by reference in its entirety.

FIELD OF THE INVENTION

The present invention relates to the field of antenna mechanisms, and is more particularly concerned with a reflector deployment and pointing mechanism one axis for the deployment of the reflector of an antenna and two other axes for the pointing thereof.

BACKGROUND OF THE INVENTION

It is well known in the art of spacecraft to have reflectors of antennas that need to be deployed once the spacecraft has reached its operating position, after being stowed during launch of the spacecraft. Most of these deployment mechanisms are passive mechanisms, such as a loaded spring or the like, such that any adjustment of the reflector position in the deployed configuration is impossible.

Other mechanisms allow for the deployment of the reflector from a stowed position and/or the pointing of the reflector while being in the deployed configuration. Such mechanisms usually sacrifice the proper focus of the RF beam in order to the achieve beam pointing on two axes.

Accordingly, there is a need for an improved reflector deployment and pointing mechanism for an antenna reflector of a spacecraft.

SUMMARY OF THE INVENTION

It is therefore a general object of the present invention to provide an improved reflector deployment and pointing mechanism for an antenna reflector of a spacecraft that could obviate the above-mentioned problems.

An advantage of the present invention is that the reflector deployment and pointing mechanism is a three axis mechanism, with one axis for the deployment of the reflector and two axes for the pointing thereof.

Another advantage of the present invention is that the reflector deployment and pointing mechanism has a first actuator mounted on a spacecraft structure, a second actuator mounted on the first actuator, and a third actuator mounted on the second actuator and connected to the reflector, the three actuators being preferably rotary actuators, with the first or second actuator being the deployment actuator, and, respectively, the second or first, and the third actuators being the pointing actuators and having their axis of rotation generally intersecting a central point of the signal reflecting surface of the reflector.

A further advantage of the present invention is that the reflector deployment and pointing mechanism substantially eliminates defocussing of the reflector, thus minimizing radio-frequency (RF) degradation of the antenna when repointing the reflector.

Still another advantage of the present invention is that the reflector deployment and pointing mechanism keeps the three (3) rotary actuators relatively close to the spacecraft reducing the overall mass of the system and increasing the deployed natural frequency of the deployed appendage.

Yet another advantage of the present invention is that the reflector deployment and pointing mechanism uses a minimum number of actuators to achieve deployment and two-axis pointing of the antenna reflector.

According to an aspect of the present invention there is provided a reflector deployment and pointing mechanism for deploying and pointing a reflector of an antenna movably mounted on a spacecraft structure, the reflector having a signal reflecting surface thereon defining a reflector axis generally perpendicular thereto and intersecting the signal reflecting surface at a feed oriented point thereof, at which an antenna feed substantially points, to define a reflector plane generally perpendicular to the reflector axis, said reflector deployment and pointing mechanism comprising:

a first actuator having a first fixed part for fixedly mounting on the spacecraft structure, and a first mobile part rotatably mounted on the first fixed part about a first axis;

a second actuator having a second fixed part fixedly mounting on the first mobile part, and a second mobile part rotatably mounted on the second fixed part about a second axis, the first and second axes being angled relative to one another (not parallel or coaxial); and a third actuator having a third fixed part fixedly mounting on the second mobile part, and a third mobile part rotatably mounted on the third fixed part about a third axis and for fixedly supporting the reflector, the third axis being generally perpendicular to the reflector axis;

wherein the reflector is movable about the first axis or the second axis between a stowed configuration wherein, respectively, the second axis or the first axis is angled relative to or intersects the reflector plane, and a deployed configuration wherein, respectively, the second axis or the first axis is generally perpendicular to the reflector axis and generally intersects the third axis at about the feed oriented point of the signal reflecting surface.

In one embodiment, the first and second axes intersect one another.

Conveniently, the first and second axes are substantially perpendicular to one another.

In one embodiment, respectively, the first axis or the second axis intersects with the third axis.

In one embodiment, at least one of the first, second and third actuators is a rotary actuator.

Conveniently, the first, second and third actuators are rotary actuators.

In one embodiment, when in the deployed configuration, respectively, the second axis or the first axis, and the third axis define an angle there between being equal to or smaller than about ninety (90) degrees.

In one embodiment, respectively, the angle between the second axis or the first axis, and the third axis is about 45 degrees.

In one embodiment, when in the stowed configuration, respectively, the second axis or the first axis is substantially parallel to the reflector axis.

In one embodiment, the feed oriented point of the signal reflecting surface is generally adjacent a center of the signal reflecting surface.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE INVENTION

With reference to the annexed drawings the preferred embodiment of the present invention will be herein described for indicative purpose and by no means as of limitation.

Figure 1:
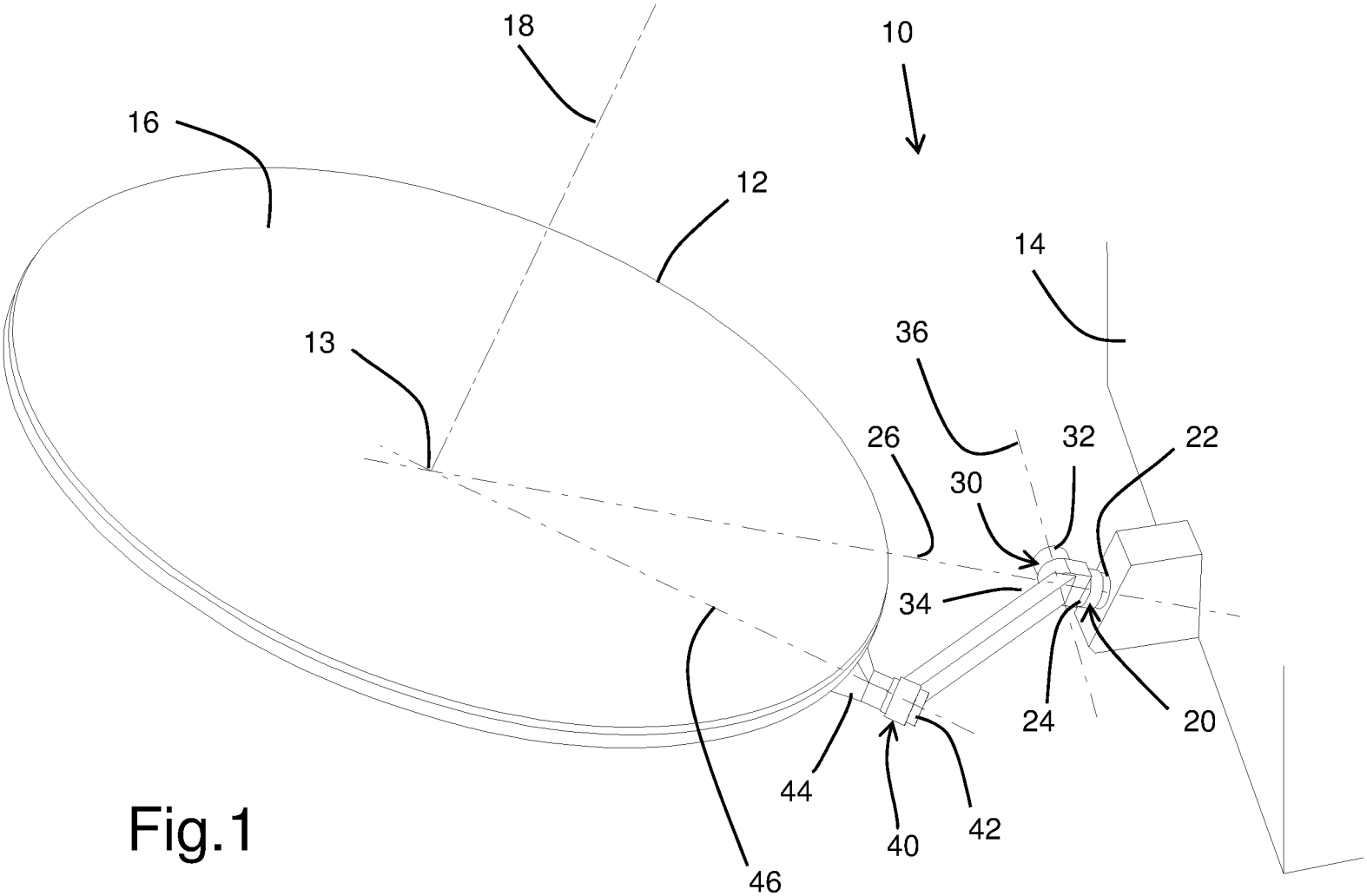
FIG. 1 is a top perspective view of an antenna reflector mounted on a spacecraft structure using a reflector deployment and pointing mechanism in accordance with an embodiment of the present invention, with the reflector shown in the deployed configuration.
Figure 2:
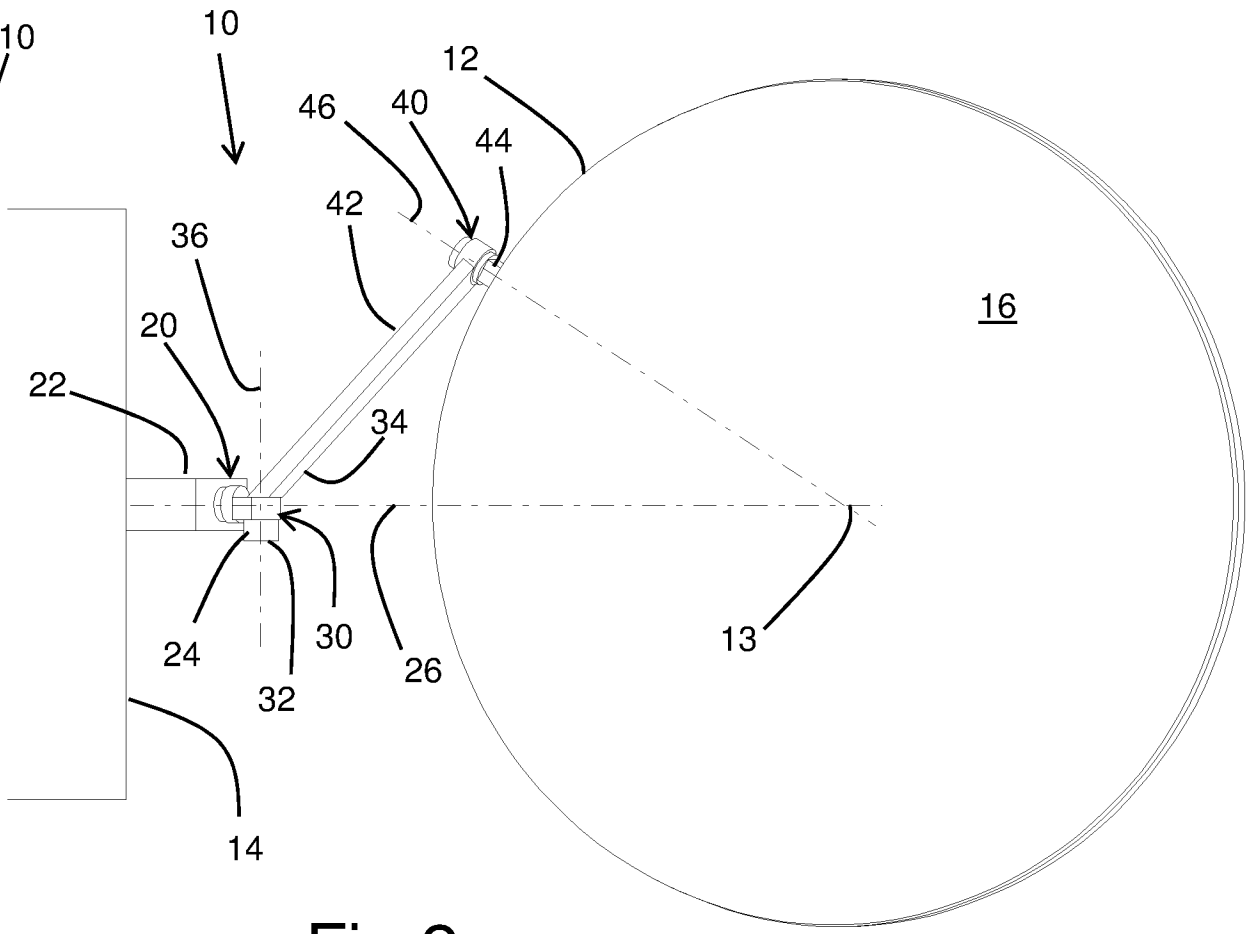
FIG. 2 is a top plan view of the embodiment of FIG. 1.
Figure 3:
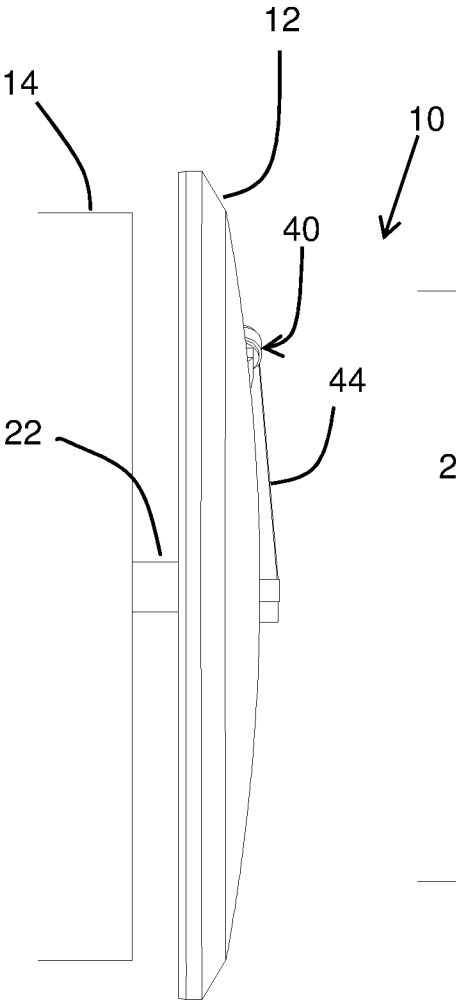
FIG. 3 is a top plan view similar to FIG. 2, with the reflector shown in the stowed configuration.
Figure 4:
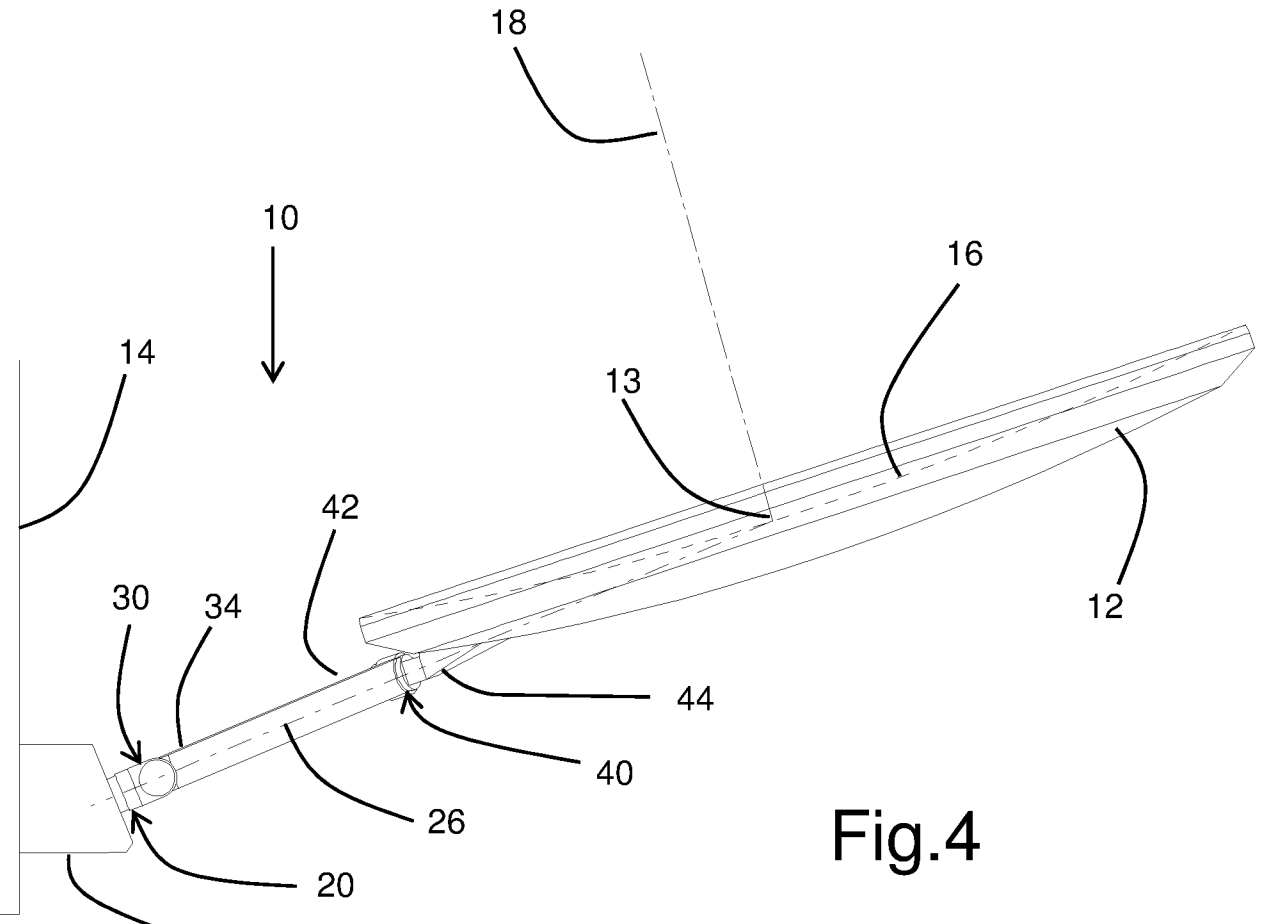
FIG. 4 is a side elevation view of the embodiment of FIG. 1.
Figure 5:
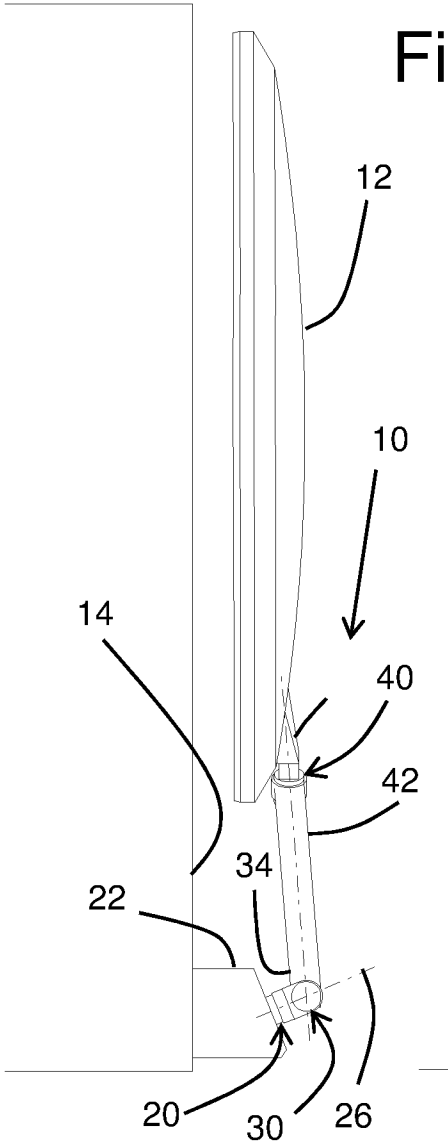
FIG. 5 is a side elevation view similar to FIG. 4, with the reflector shown in the stowed configuration.

Referring to FIGS. 1 through 5, there is shown a reflector deployment and pointing mechanism in accordance with an embodiment 10 of the present invention supporting an antenna reflector 12 on a spacecraft structure 14. The reflector deployment and pointing mechanism 10 typically first deploys the reflector 12 from a stowed configuration shown in FIGS. 3 and 5 into a deployed configuration shown in FIGS. 1, 2 and 4, before allowing the pointing of the reflector 12 that is movably mounted on a spacecraft structure 14. The reflector 12 has a signal reflecting surface 16 thereon that defines a reflector axis 18 generally perpendicular thereto and intersecting the signal reflecting surface 16 at a typically feed oriented point 13 thereof, typically adjacent a center of the surface 16, at which an antenna feed (not shown) substantially points, to define a reflector plane generally perpendicular to the reflector axis 18.

The reflector deployment and pointing mechanism 10 includes a first actuator 20 having a first fixed part 22 fixedly mounting on the spacecraft structure 14, and a first mobile part 24 rotatably mounted on the first fixed part 22 about a first axis 26. A second actuator 30 has a second fixed part 32 fixedly mounting on the first mobile part 24, and a second mobile part 34 rotatably mounted on the second fixed part 32 about a second axis 36, typically the deployment axis, with the first 26 and second 36 axes being angled (not parallel or coaxial), and preferably perpendicular relative to one another. A third actuator 40 has a third fixed part 42 fixedly mounting on the second mobile part 34, and a third mobile part 44 rigidly supporting the reflector 12 and rotatably mounted on the third fixed part 42 about a third axis 46, with the third 46 axis being generally perpendicular to the reflector axis 18.

Typically, as illustrated, the reflector 12 moves about the second axis 36 between a stowed configuration, wherein the first axis 26 is at an angle relative to the reflector plane (see FIG. 5) or intersects the reflector plane, and preferably is perpendicular thereto (or preferably substantially parallel to the reflector axis 18), and a deployed configuration, wherein the first axis 26 is generally perpendicular to the reflector axis 18 and generally intersects the third axis 46 at about the feed oriented point 13 of the signal reflecting surface 16 in order to substantially eliminates defocussing of the reflector 12, thus minimizing RF degradation of the antenna when repointing the reflector 12.

Typically, in the deployed configuration, the first 20 and third 40 actuators are used to control the pointing of the antenna reflector 12 when in the deployed configuration first, via the first axis 26 to control the elevation orientation of the reflector 12, and third axis 46 to control both the elevation and cross elevation orientations of the reflector 12. Preferably, the first and third axes define an angle of about 45 degrees there between, as shown. Although not preferred because of structural reasons, the third axis 46 could be oriented perpendicular to the first axis 26, and parallel to the second axis 36, to control only the cross elevation orientation of the reflector 12.

In the embodiment 10 shown, the first 26 and second 36 axes intersect one another, and are preferably substantially perpendicular to one another. Alternatively, although not illustrated, they could not intersect one another, without departing from the scope of the present invention.

Similarly, in the embodiment 10 shown, the second 36 and third 46 axes intersect one another, although they could also not intersect one another (not shown) without departing from the scope of the present invention.

In an alternate embodiment (not shown), the first 20 and second 30 actuators could be reversed, such that the reflector 12 would move about the first axis between the stowed and deployed configurations, and the second axis would be generally perpendicular to the reflector axis 18 and would generally intersect the third axis 46 at about the feed oriented point 13 in the deployed configuration, and so on.

In the embodiment 10 shown, at least one of, but preferably all of the first 20, second 30 and third 40 actuators are rotary actuators. Alternatively, although not illustrated, anyone of the actuators 20, 30, 40, or all three, could have its rotation being driven by a linear actuator (such as a rack and pinion assembly) or the like, without departing from the scope of the present invention.

Although not illustrated, one skilled in the art would readily realize that, without departing from the scope of the present invention, the deployed and pointed payload could be any payload instead of a reflector.

Although the present invention has been described with a certain degree of particularity, it is to be understood that the disclosure has been made by way of example only and that the present invention is not limited to the features of the embodiments described and illustrated herein, but includes all variations and modifications within the scope of the invention as hereinabove described and/or hereinafter claimed.

We claim:

1. A reflector deployment and pointing mechanism for deploying and pointing a reflector of an antenna movably mounted on a spacecraft structure, the reflector having a signal reflecting surface thereon defining a reflector pointing axis generally perpendicular thereto and intersecting the signal reflecting surface at a feed oriented point thereof, at which an antenna feed substantially points, to define a reflector plane generally perpendicular to the reflector pointing axis, said reflector deployment and pointing mechanism comprising:

a first actuator having a first fixed part for fixedly mounting on the spacecraft structure, and a first mobile part rotatably mounted on the first fixed part about a first rotation axis;

a second actuator having a second fixed part fixedly mounting on the first mobile part, and a second mobile part rotatably mounted on the second fixed part about a second rotation axis, the first and second rotation axes being angled relative to one another; and a third actuator having a third fixed part fixedly mounting on the second mobile part, and a third mobile part rotatably mounted on the third fixed part about a third rotation axis and for fixedly supporting the reflector, the third rotation axis being generally perpendicular to the reflector pointing axis;

wherein the reflector is movable about the first rotation axis or the second rotation axis between a stowed configuration, wherein, respectively, the second rotation axis or the first rotation axis intersects the reflector plane, and a deployed configuration, wherein, respectively, the second rotation axis or the first rotation axis is generally perpendicular to the reflector pointing axis and generally intersects the third rotation axis at about the feed oriented point of the signal reflecting surface.

2. The mechanism of claim 1, wherein the first and second rotation axes intersect one another.

3. The mechanism of claim 2, wherein the first and second rotation axes are substantially perpendicular to one another.

4. The mechanism of claim 1, wherein, respectively, the first rotation axis or the second rotation axis intersects with the third rotation axis.

5. The mechanism of claim 1, wherein at least one of the first, second and third actuators is a rotary actuator.

6. The mechanism of claim 5, wherein the first, second and third actuators are rotary actuators.

7. The mechanism of claim 1, wherein, when in the deployed configuration, respectively, the second rotation axis or the first rotation axis, and the third rotation axis define an angle therebetween being equal to or smaller than about ninety (90) degrees.

8. The mechanism of claim 7, wherein, respectively, the angle between the second rotation axis or the first rotation axis, and the third rotation axis is about 45 degrees.

9. The mechanism of claim 1, wherein, when in the stowed configuration, respectively, the second rotation axis or the first rotation axis is substantially parallel to the reflector pointing axis.

10. The mechanism of claim 1, wherein the feed oriented point of the signal reflecting surface is generally adjacent a center of the signal reflecting surface.

* * * * *